United States Patent [19]

Schöffl

[11] Patent Number: 4,488,489

[45] Date of Patent: Dec. 18, 1984

[54] ORDNANCE SYSTEM HAVING A WARHEAD WITH SECONDARY ELEMENTS AS A PAYLOAD

[75] Inventor: Rainer Schöffl, Odenthal, Fed. Rep. of Germany

[73] Assignee: Dynamit Nobel Aktiengesellschaft, Troisdorf, Fed. Rep. of Germany

[21] Appl. No.: 330,850

[22] Filed: Dec. 15, 1981

[30] Foreign Application Priority Data

Dec. 23, 1980 [DE] Fed. Rep. of Germany ..... 3048617

[51] Int. Cl.[3] ..... F42B 13/24; F42B 13/50; F42B 25/16

[52] U.S. Cl. ..... 102/489; 102/350; 102/374; 102/393

[58] Field of Search ..... 102/489, 703, 393, 394, 102/504, 505, 350, 351, 374, 377, 378

[56] References Cited

U.S. PATENT DOCUMENTS

| | | | |
|---|---|---|---|
| 3,276,367 | 10/1966 | Edwards | 102/393 |
| 3,712,219 | 1/1973 | Blair et al. | 102/393 |
| 3,712,229 | 1/1973 | Schock | 102/489 |
| 3,760,730 | 9/1973 | Osborne et al. | 102/377 |

*Primary Examiner*—Charles T. Jordan
*Assistant Examiner*—Ted L. Parr
*Attorney, Agent, or Firm*—Antonelli, Terry & Wands

[57] ABSTRACT

An ordnance system which includes a warhead accommodating a number of secondary elements, especially explosive elements as a payload, with the secondary elements adapted to be distributed over a target area. The warhead includes a coaxially arranged rotation-producing propulsion unit such as a rocket engine.

23 Claims, 1 Drawing Figure

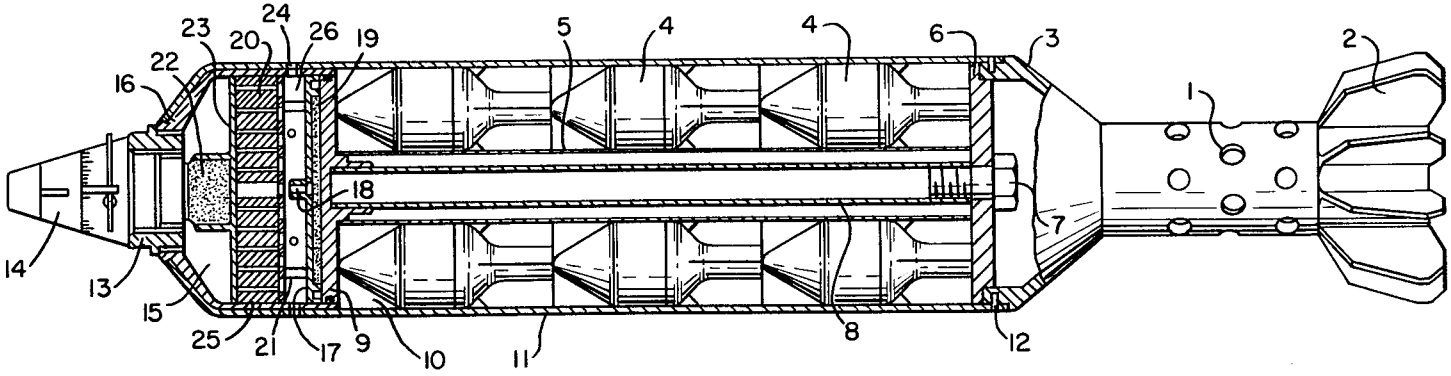
2
1
3
7
12
6
4
8
4
5
11
10
19
18
9
26
17
24
21
20
25
23
22
15
16
13
14

ORDNANCE SYSTEM HAVING A WARHEAD WITH SECONDARY ELEMENTS AS A PAYLOAD

The present invention relates to an ordnance system and, more particularly, to an ordnance system provided with a warhead equipped with secondary elements, especially explosive elements as a payload, with the secondary elements adapted to be distributed over a target area.

It has been proposed to utilize warheads as a means for transporting a payload of secondary elements or entities into a predetermined target area, with the secondary elements then being deployed for their respective purpose optionally after first being properly distributed. Thus, it has been proposed to, for example, convey secondary explosive elements as a payload of an unguided rocket into target areas and then to use the same after a corresponding distribution for combating enemy vehicle accumulations.

In order to attain a satisfactory distribution of the secondary elements, it is necessary to radially accelerate the secondary elements after a release from the warhead in, preferably, differing directions in addition to providing the necessary axial movement. Thus, for example, it has been proposed to transport the secondary elements by means of spin-stabilized shells wherein the secondary elements, after an ejection from the shell case, are distributed due to the effective centrifugal forces.

It has also been proposed to arrange the secondary elements around the gas generator, with the generator being adapted to drive the secondary elements apart after a case of the warhead has been burst open.

Certain disadvantages and difficulties have been encountered in the above proposed ordnance systems. For example, in one case, difficulties are encountered because the applicability is limited to spin-stabilized shells inasmuch as wing-stabilized projectiles or rockets do not yield the high rotational speed about their axes required for satisfactory distribution but rather suffer reduction in rotational speed and thus a lessening, if not a total loss, of stability. Additionally, there is a danger of damage to the secondary elements when the warhead case is burst open as well as when the secondary elements are driven apart by the gas generator thereby leading to a system of questionable operability.

The aim underlying the present invention essentially resides in providing an ordnance system having a warhead equipped with secondary elements which ensures a proper distribution of the secondary elements over a target area.

In accordance with advantageous features of the present invention, a warhead with seconary explosive elements as a payload is provided with a coaxially disposed rotation producing propulsion unit such as, for example, a rocket engine.

By virtue of the provision of a coaxially arranged rotation-producing rocket engine, it is then possible to accelerate the warhead plus the secondary payload to a high rotational speed about its longitudinal axis directly before release of the secondary elements.

Since the high speed of rotation is attained in a very short time, a reduction in aerodynamic stability cannot have an effect on the flight path or position of the projectile or rocket. For this purpose, according to the present invention, a rocket engine which burns only for a short period of time is sufficient since it will produce the desired and necessary rotational speed in a substantially shorter period of time than would be possible with, for example, aerodynamic devices.

Advantageously, in accordance with the present invention, the ignition of the rocket engine at the correct point in time may be executed in various manners. For example, the ignition of the rocket engine may be possible from the ground by a remote control ignition. For this purpose, according to the present invention, a delayed-action fuse or time fuse is arranged in a tip of the warhead, with the fuse in a functional connection with the rocket engine.

An advantage of the last noted features of the present invention reside in the fact that, assuming a course of a perfect functioning of the igniter, with an appropriate set delayed-action fuse no effect needs to be exerted on the warhead after its firing regardless of any other occurrences.

For a warhead of a conventional construction, that is, a warhead wherein the payload is accommodated within a warhead casing or covering between a forward cover disk and a rearward base or bottom fixedly joined to the disk by means of a central tube, rod, or the like, in accordance with the present invention, a rocket engine is maintained in an operative connection with a propellant or separating charge through an ignition transfer or transmitter means with delay. After an ignition at a desired point in time, the propellant or separating charge is effective so as to pull away the warhead case or covering with the rocket engine toward the front, as viewed in a direction of travel of the warhead, with the warhead case or covering then releasing the payload, that is, the secondary elements.

Advantageously, in accordance with further features of the present invention, the rocket engine forming the propulsion unit is of a disk shape and is constructed of a plurality of axially parallel disposed tubular propellant bodies or grains, with the rocket engine being connected by way of a gas space from behind the rocket engine to tangentially disposed nozzle orifices provided in the warhead casing or covering so as to enable exiting gases to impart to the warhead the desired spin about its longitudinal axis.

Accordingly, it is an object of the present invention to provide an ordnance system having a warhead with secondary elements as a payload which avoids, by simple means, shortcomings and disadvantages encountered in the prior art.

Another object of the present invention resides in providing an ordnance system having a warhead with secondary elements as a payload having high aerodynamic stability.

Yet another object of the present invention resides in providing an ordnance system having a warhead with secondary elements as a payload which ensures a satisfactory deployment of the secondary elements.

A still further object of the present invention resides in providing an ordnance system having a warhead with secondary elements as a payload which enables the deployment of the secondary elements in chronological succession so as to obtain a more extensive distribution of the payload on a target area.

These and other objects, features, and advantages of the present invention will become more apparent from the following description when taken in connection with the accompanying drawing which shows, for the purposes of illustration only, one embodiment in accordance with the present invention, and wherein:

The single FIGURE of the drawing is a longitudinal cross sectional view of an ordnance system such as, for example, a mortar shell, constructed in accordance with the present invention.

Referring now to the single FIGURE of the drawing, according to this FIGURE, a tailstem or strut 1 with stabilizer wings or fins 2 and base member 3 is constructed in a conventional manner, with secondary elements 4, constructed as mini-bombs being arranged about a spacer or bearing tube 5 and supported on a dish shaped bottom plate 6. The dish shaped bottom plate 6 is joined to a lid 9 by way of a tubular element 8 and a threaded fastener or screw 7. This lid 9 constitutes or forms a forward cover of a payload chamber 10 accommodating the secondary elements 4. An outer envelope of the mortar shell includes a head case or cover 11 connected to the dish shaped bottom plate 6 by appropriate shear pins 12. The head case or cover 11 terminates at a forward end in a threaded bushing 13, with a delayed-action fuse 14 being threadably mounted or accommodated in the bushing 13.

A forward portion 15 of the head case or covering 11 forms a housing for accommodating a spin rocket engine and, for this purpose, the forward part 15 is reinforced by an insert 16 formed, for example, of steel or the like; whereas, the remainder of the head case or covering 11 may be manufactured of, for example, aluminum or a glass fiber reinforced synthetic resin.

A disc-shaped plate or base member 17 is threadably inserted into the reinforcing insert 16, with the disc-shaped plate or base member 17 containing an ignition transfer means 18 with delay. A propellant charge 19 is located between the disc-shaped plate or base member 17 and the lid 9, and tubular propellant grains or bodies 20 are supported on a holder or spacer 21, whereby the rocket engine 25 and disk-shaped plate or base member 17 form an interspace 26 which functions as a gas accumulation chamber. The tubular propellant bodies or grains 20 are ignited by an ignition or initiator charge 22 arranged in a cover disk 23.

The igniter charge 22 connects a forward planar surface of the rocket engine 25 with the delayed action fuse 14, while the holders or spacers 21 maintain a rearward planar surface of the rocket engine 25 from the base member 17. Combustion gases of the tubular propellant grains or bodies 20 flow away through a plurality of tangential orifices 24.

After a pre-set flying period, the fuse 14 initiates the igniter charge 22 which, in turn, ignites tubular propellant grains or bodies 20. Combustion gases of the tubular propellant grains 20, exiting tangentially through the interspace 26 by way of the nozzle orifices 24, exert a torque on the shell so that the shell is brought to a high rotational speed about the longitudinal axis within a short period of time. By a burning of the tubular propellant grains or bodies 20, the ignition transfer means 18 is ignited, the delay period of the ignition of the ignition transfer means is predetermined or dimensioned so that the propellant charge 19 is ignited immediately after burn-out of the tubular propellant grains or bodies 20.

A burning of the propellant charge 19 results in a severing of the shear pins 12 and a forward ejection of the head case or covering 11. The secondary elements 4 accommodated in the payload chamber 10 are thus released and are radially displaced outwardly due to centrifugal forces. By selecting the strength of the propellant charge 19, the velocity may be affected at which the head case or covering 11 is ejected forwardly so that individual layers of secondary elements 4 are then dropped in chronological succession thereby obtaining a more extensive distribution of the secondary elements 4 on the ground or target area.

While I have shown and described only one embodiment in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. An ordnance system including a wing-stabilized warhead accommodating a plurality of secondary elements forming a payload, characterized in that propulsion means are coaxially disposed in the warhead for producing a high speed rotation of the warhead about a longitudinal axis thereof, the propulsion means being enabled at a time subsequent to launching of the warhead along a portion of the flight path for producing the high speed rotation of the warhead so as to enable distribution of the secondary elements, the propulsion means producing the high speed rotation of the warhead directly before a release of the secondary elements.

2. An ordnance system for launching along a flight path including a wing-stabilized warhead accommodating a plurality of secondary elements forming a payload, the wing-stabilized warhead including wing stabilizers disposed on the warhead for enabling rotation of the warhead for stabilization thereof, characterized in that propulsion means are coaxially disposed in the warhead for producing a high speed rotation of the warhead about a longitudinal axis thereof, the propulsion means being enabled at a time subsequent to launching along a portion of the flight path for producing the high speed rotation of the warhead so as to enable distribution of the secondary elements over a target area.

3. A system according to claim 1 or 2, characterized in that the propulsion means includes a rocket engine.

4. A system according to claim 3, characterized in that the secondary elements are explosive elements.

5. A system according to claim 3, characterized in that a delayed action fuse means is provided in the warhead and is operatively connected with the rocket engine for operating the same.

6. A system according to claim 5, characterized in that the delayed action fuse means is disposed in a tip of the warhead.

7. A system according to claim 6, characterized in that a covering means is provided for covering the payload, a first disk-shaped plate means is disposed at a forward end of the covering means, a second plate means is disposed at a rear end of the covering means, a centrally disposed axially extending member is provided for firmly connecting the first plate means to the second plate means, a further plate means is arranged between the rocket engine and the first plate means, means are disposed between the further plate means and the first plate means for separating the covering means from the warhead, and in that means are provided on the further plate means for operatively connecting the rocket engine with the means for separating.

8. A system according to claim 7, characterized in that the means for separating includes a propellant charge accommodated between the further plate means and the first plate means, and in that the means for connecting the rocket engine with the means for separating includes an igniter transfer means operable with a delay disposed coaxially in the further plate means.

9. A system according to claim 8, characterized in that the rocket engine is disposed in a tip of the warhead.

10. A system according to claim 9, characterized in that the centrally disposed axially extending member has a tubular configuration, and in that the further plate means is firmly joined to the covering means.

11. A system according to claim 8, characterized in that the rocket engine is of a disk-shape and includes a plurality of axially parallel tubular propellant grains, means are provided for connecting a forward planar surface of the rocket engine with the delayed action fuse means, means are provided for maintaining a rearward planar surface of the rocket engine at a predetermined distance from the further plate means thereby defining a chamber between the rearward planar surface, the further plate means, and the covering means, and in that nozzle means are provided in the covering means in communication with the chamber so as to enable a discharge of gas from the chamber and a rotary propulsion of the warhead.

12. A system according to claim 11, characterized in that the means for connecting the forward planar surface with the delayed action fuse means includes an igniter charge means for igniting the rocket engine.

13. A system according to claim 12, characterized in that the means for maintaining the rearward planar surface from the further plate means includes a plurality of spacers.

14. A system according to claim 1 or 2, characterized in that a covering means is provided for covering the payload, a first disk-shaped plate means is disposed at a forward end of the covering means, a second plate means is disposed at a rear end of the covering means, a centrally disposed axially extending member is provided for firmly connecting the first plate means to the second plate means, a further plate means is arranged between the propulsion means and the first plate means, means are disposed between the further plate means and the first plate means for separating the covering means from the warhead, and in that means are provided on the further plate means for operatively connecting the propulsion means with the means for separating.

15. A system according to claim 14, characterized in that the means for separating includes a propellant charge accommodated between the further plate means and the first plate means, and in that the means for connecting the propulsion means with the means for separating includes an igniter transfer means operable with a delay disposed coaxially in the further plate means.

16. A system according to claim 14, characterized in that the propulsion means includes a rocket engine.

17. A system according to claim 16, characterized in that the rocket engine is disposed in a tip of the warhead.

18. A system according to claim 1 or 2, characterized in that covering means for covering the payload are provided, the propulsion means is of a disk-shape and has a foward and rearward planar surface, the propulsion means includes a plurality of axially parallel tubular propellant bodies disposed in the warhead, a fuse means is provided in the warhead, means are provided for operatively connecting the fuse means with the forward planar surface, means cooperating with the rearward planar surface for forming a chamber, nozzle means are provided in the covering means in communication with the chamber for enabling a discharge of gas from the propulsion means to as to produce the rotation of the warhead.

19. A system according to claim 18, characterized in that means for connecting the forward planar surface with the fuse means includes an igniter charge means for igniting the propulsion means.

20. A system according to claim 19, characterized in that the propulsion means is disposed in a tip of the warhead.

21. A system according to claim 20, characterized in that means are provided in a tip of the warhead for reinforcing the same.

22. A system according to claim 1 or 2, characterized in that a covering means is provided for covering the payload, and in that means are provided for separating the covering means from the warhead in a forward direction.

23. A system according to claim 2, wherein the propulsion means is enabled a short time prior to intended release of the secondary elements.

* * * * *